US009399247B2

(12) United States Patent
Schaefer

(10) Patent No.: US 9,399,247 B2
(45) Date of Patent: Jul. 26, 2016

(54) PIPE MANIPULATOR

(75) Inventor: August-Wilhelm Schaefer, Frankenau (DE)

(73) Assignee: AWS SCHAEFER TECHNOLOGIE GMBH, Wilnsdorf (DE)

( * ) Notice: Subject to any disclaimer, the term of this patent is extended or adjusted under 35 U.S.C. 154(b) by 1206 days.

(21) Appl. No.: 13/265,163

(22) PCT Filed: Jan. 6, 2011

(86) PCT No.: PCT/DE2011/000008
§ 371 (c)(1),
(2), (4) Date: Nov. 8, 2011

(87) PCT Pub. No.: WO2011/085713
PCT Pub. Date: Jul. 21, 2011

(65) Prior Publication Data
US 2012/0192612 A1 Aug. 2, 2012

(30) Foreign Application Priority Data
Jan. 15, 2010 (DE) ..... 10 2010 004 822

(51) Int. Cl.
*B21D 7/16* (2006.01)
*B21D 43/00* (2006.01)

(52) U.S. Cl.
CPC ..... *B21D 7/162* (2013.01); *B21D 43/006* (2013.01)

(58) Field of Classification Search
CPC ..... B21D 7/024; B21D 7/025; B21D 7/162; B21D 7/16; B21D 9/01; B21D 9/03; B21D 43/006
See application file for complete search history.

(56) References Cited

U.S. PATENT DOCUMENTS

| | | | | |
|---|---|---|---|---|
| 2,862,540 A | | 12/1958 | Mellinger | |
| 3,109,477 A | * | 11/1963 | Avera et al. | 72/466 |
| 3,747,394 A | * | 7/1973 | Cunningham | 72/466 |
| 4,022,045 A | * | 5/1977 | Riha | 72/128 |
| 2010/0300169 A1 | | 12/2010 | Schaefer | |

FOREIGN PATENT DOCUMENTS

| | | |
|---|---|---|
| DE | 1966496 U | 8/1967 |
| DE | 2630967 A1 | 1/1978 |

(Continued)

OTHER PUBLICATIONS

European Patent Office, International Search Report in International Patent Application No. PCT/DE2011/000008 (May 27, 2011).

*Primary Examiner* — Shelley Self
*Assistant Examiner* — Pradeep C Battula
(74) *Attorney, Agent, or Firm* — Leydig, Voit & Mayer, Ltd.

(57) ABSTRACT

A pipe manipulator is configured to move a pipe in an apparatus for bending a pipe. The apparatus includes a feeding device, a heating device configured to annularly surround the pipe. at least one bending arm disposed axially downstream from the heating device in a pipe feed direction, and a bending lock disposed on the at least one bending arm and configured to grasp a pipe section to be bent and to move around a bending axis of rotation during a feeding of the pipe. The pipe manipulator includes a receiving sleeve axially displaceable in the pipe feed direction and disposed displaceably in the feeding device at an end of the pipe. The receiving sleeve is configured to reach into the pipe and to firmly clamp the pipe from an inside of the pipe and to guide the pipe in a defined manner axially through the heating device.

3 Claims, 3 Drawing Sheets

(56) References Cited

FOREIGN PATENT DOCUMENTS

| | | | |
|---|---|---|---|
| DE | 3147688 | A1 | 6/1983 |
| FR | 1442832 | A1 | 6/1966 |
| GB | 2110976 | A | 6/1983 |
| WO | WO 2008135033 | A1 | 11/2008 |

* cited by examiner

PIPE MANIPULATOR

CROSS REFERENCE TO PRIOR APPLICATIONS

This application is a U.S. National Phase Application under 35 U.S.C. §371 of International Application No. PCT/DE2011/000008, filed on Jan. 6, 2011, and claims priority to German Application No. DE 10 2010 004 822.4, filed on Jan. 15, 2010. The International Application was published on Jul. 21, 2011 as WO 2011/085713 under PCT Article 21 (2).

FIELD

The invention relates to an apparatus and to a method for loading and for introducing pipes into pipe bending machines.

BACKGROUND

The handling of the bent pipes is a problem here. For each bending operation, the pipe to be bent has to be clamped at the straight end thereof in a feed carriage while a bending lock is fastened to the end to be bent. An annular apparatus for inductive heating, customarily also referred to as an induction ring, is located between the bending lock and feed carriage. Said induction ring has to be removed in a complicated manner for all reclamping and loading operations, and then re-installed and aligned since, otherwise, there would be the risk of pipes swinging during transportation being damaged. This generally means a considerably delay in the bending operations, this delay placing a crucial limit on the turnover of a pipe bending machine.

SUMMARY OF THE INVENTION

In an embodiment, the present invention provides a pipe manipulator for moving a pipe in an apparatus for bending a pipe having a large diameter. The apparatus includes a feeding device, a heating device configured to annularly surround the pipe, at least one bending arm disposed axially downstream from the heating device in a pipe feed direction, and a bending lock disposed on the at least one bending arm and configured to grasp a pipe section to be bent and to move around a bending axis of rotation during a feeding of the pipe. The pipe manipulator includes a receiving sleeve axially displaceable in the pipe feed direction and disposed displaceably in the feeding device at an end of the pipe. The receiving sleeve is configured to reach into the pipe and to firmly clamp the pipe from an inside of the pipe and to guide the pipe in a defined manner axially through the heating device into the bending lock.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
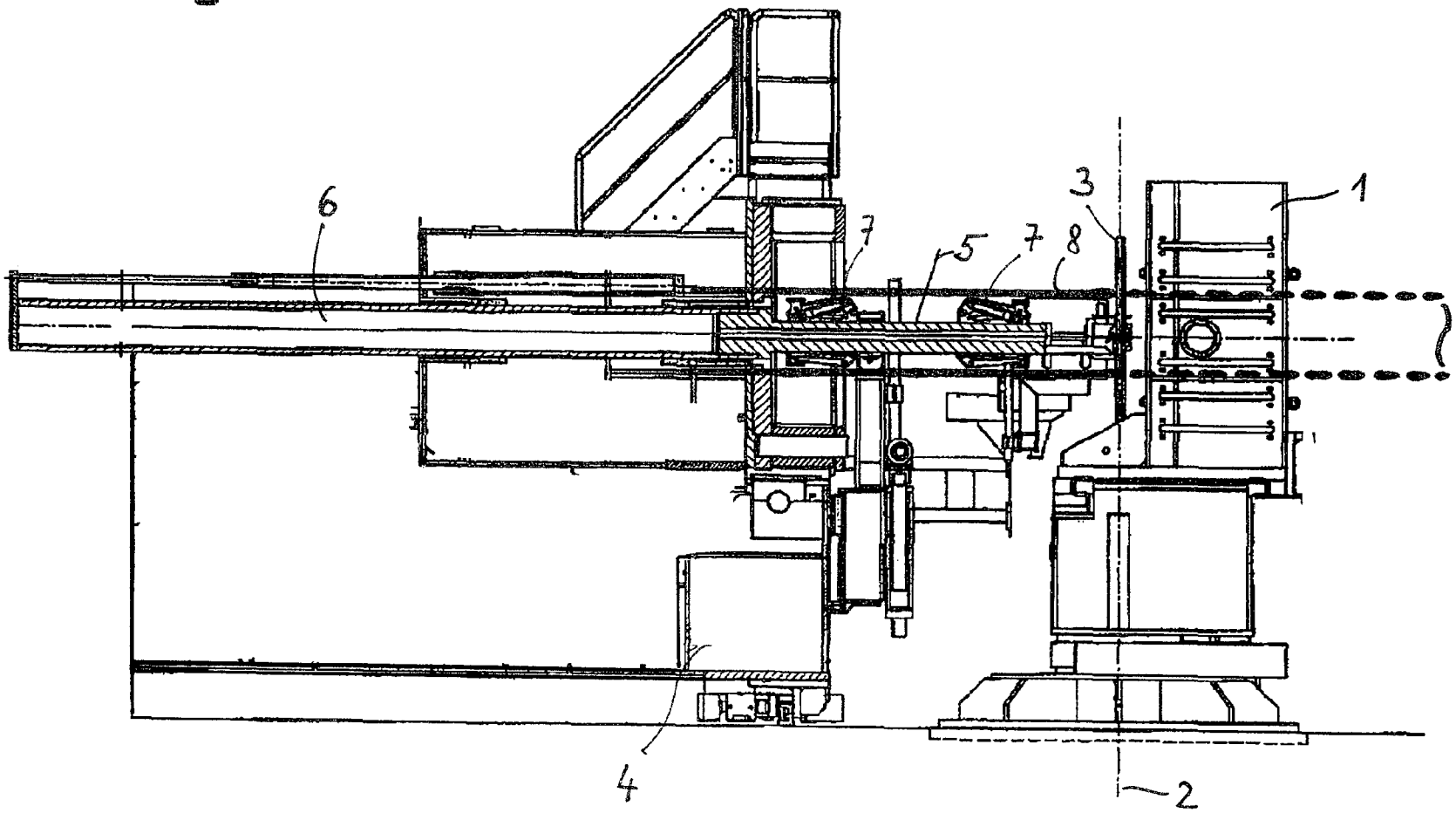
FIG. 1 shows an overview of the parts of the bending machine and the interaction thereof with the pipe manipulator.

In an embodiment, the present invention provides an apparatus which shortens and simplifies the reclamping and loading operations for pipe bending machines and therefore increases the throughput which can be achieved for machines of this type and therefore the economic efficiency thereof.

In an embodiment, the pipes to be bent are inductively heated at the bending point. The pipes here are frequently thick-walled steel pipes with wall thicknesses of 3 to up to 120 mm and with large diameters of 400 to 1660 mm and weights of several tons. The pipe bending machines which are developed for this purpose and with which bending radii of 1 to 10 meters can be realized are also correspondingly large and heavy.

An embodiment of the present invention provides a pipe manipulator for moving pipes for use in an apparatus for bending pipes of larger diameters, wherein

- in said bending apparatus, a pipe is guided in the axial direction through a heating device which annularly surrounds said pipe,
- at least one bending arm is located in that part of the bending apparatus which is positioned in the feeding direction of the pipe,
- wherein a bending lock located on the bending arm firmly grasps the pipe section to be bent and moves around the bending axis of rotation during the feeding of the pipe,
- a receiving sleeve which is displaceable axially in the feeding direction of the pipe is installed displaceably in the feeding device at the end of the pipe,
- the receiving sleeve reaches from the inside into the pipe and, in the process, firmly clamps the pipe from the inside,
- the receiving sleeve guides the pipe in a defined manner axially through the heating device into the front clamping device.

It is thereby possible to omit removal and re-installation of the induction ring, since the pipe can be guided precisely through the induction ring until the rear pipe end can be clamped far enough upstream of the induction system without having to be concerned about deflecting movements of the pipe with a destructive effect. The receiving sleeve applies the force with which the pipe is guided through the heating device. The pipe manipulator in this case includes the receiving sleeve and the apparatuses which serve to move the receiving sleeve in the axial direction, said apparatuses corresponding to the customary feed apparatuses according to the conventional prior art.

In order to solve difficulties of this type, other clamping devices for guiding pipes have also already been described in the prior art. For this purpose, DE-A 26 30 967 describes bending a pipe and removing the pipe from the bending apparatus by means of a receiving mandrel without having to remove the induction ring. However, the receiving mandrel is not used as a feed and also not as a tool in order to grip the pipe and introduce the pipe into the pipe bending machine.

DE 31 47 688 A1 describes a rapid clamping apparatus for a pipe, with which the intention is to achieve a non-bendable pipe length which is as small as possible at the clamping end, wherein a radial clamping movement is obtained by bolt-shaped expanding grippers with a plurality of longitudinal slots distributed over the circumference. For this purpose, the expanding grippers are also pulled over the one end of the pipe to be bent. However, with technology of this type, only small differences in wall thickness can be compensated for, and the tool cannot be used over a large pipe diameter spectrum. It is also not possible to guide the rear pipe end through the heating apparatus.

Further clamping grippers for pipes are described in DE 1 966 496 U and U.S. Pat. No. 2,862,540. However, even said clamping grippers are not suitable for picking up large pipes of changing diameters and for bending said pipes inductively in pipe bending machines.

In an embodiment of the invention, it is provided that the receiving sleeve fixes the pipe to be bent in at least two holding planes which are perpendicular to the horizontal center axis of the pipe. With such a receiving apparatus on the inside of the pipe, it is possible to firmly hold the pipe in such a manner that the pipe cannot slip either in the longitudinal direction or in the tangential direction. The two holding planes have to be located sufficiently far apart that they can reliably absorb the large lever forces without leading to deformation at the force introducing points of the pipes. Further holding planes may be provided for assistance.

In a further embodiment of the invention, it is provided that the fixing takes place frictionally in each of the holding planes by means of holding apparatuses which are pressed from the inside against the pipe. In this connection, due to the considerable forces, care has to be taken to ensure compressive forces which are defined and which can be limited, and sufficient force introducing surfaces.

In a further embodiment of the invention, it is provided that the holding apparatuses in each plane are formed by holding levers which have, at the outer ends thereof, force introducing elements for the inside of the pipe, the holding levers being actuated by a hydraulic system within the receiving sleeve and, in the process, being expanded concentrically. The holding levers here can be arranged moving in the same direction or in opposed directions. In the event of movement in the same direction, the force introducing surfaces of the various holding planes can also be connected to one another.

In a further embodiment of the invention, it is provided that 3, 4, 5 or 6 holding levers are provided in each of the holding planes, the holding levers being distributed uniformly over the circumference.

In a further embodiment of the invention, it is provided that the receiving sleeve is rotatable. This facilitates the clamping during multiple bending operations and makes it possible for the pipe to be rotated after a plurality of possibly spatially complicated bending operations in such a manner that reliable removal of the pipe is made possible.

An embodiment of the invention also relates to a method for loading and guiding a pipe upstream and downstream of a bending operation by means of an apparatus according to the invention, with the following steps:

a) positioning the pipe to be bent in axial alignment upstream of the pipe manipulator,
b) introducing the receiving sleeve of the pipe manipulator, with the holding levers pulled in, into the pipe until at least two holding planes are within the pipe to be bent,
c) hydraulically extending the holding levers until the pipe is firmly held by the receiving sleeve,
d) drawing the pipe through the closed induction ring as far as the position at which the pipe can be clamped in the feed carriage,
e) pushing and at the same time bending the pipe by means of inductive heating,
f) after the bending operation has ended, pushing the bent pipe out through the induction ring, which is closed but is switched off, into the front clamping device,
g) clamping the pipe in the bending arm lock,
h) hydraulically retracting the holding levers,
i) removing the receiving sleeve from the pipe,
j) transporting away the pipe.

It is therefore no longer necessary to position the pipe in the bending machine by means of cranes. Furthermore, customary bending operations can be carried out in a single step without a waiting period until the pipe has cooled, which considerably improves productivity because it considerably accelerates the entire bending operation.

The transporting away can then take place in a simple manner, for example by means of a hall crane.

During the bending operation, care has to be taken to ensure that, when the relevant force introducing surface passes into the vicinity of the induction ring, holding levers are not extended but rather the holding levers are in the parking position.

FIG. 1 shows the bending machine with a bending lock 1, and the bending axis of rotation 2, with the induction ring 3 also lying in the same plane behind the bending lock. The receiving sleeve 5 which is connected to the feed rod 6 and has the holding levers 7 is located on the front part of the feed carriage 4. Receiving sleeve 5, feed rod 6 and the holding levers 7 form the pipe manipulator. The inserted pipe 8 is shown as far as the induction ring 3 and indicated by dashed lines thereafter only in the unbent state.

Figures 2A, 2B, 2C, 2D:
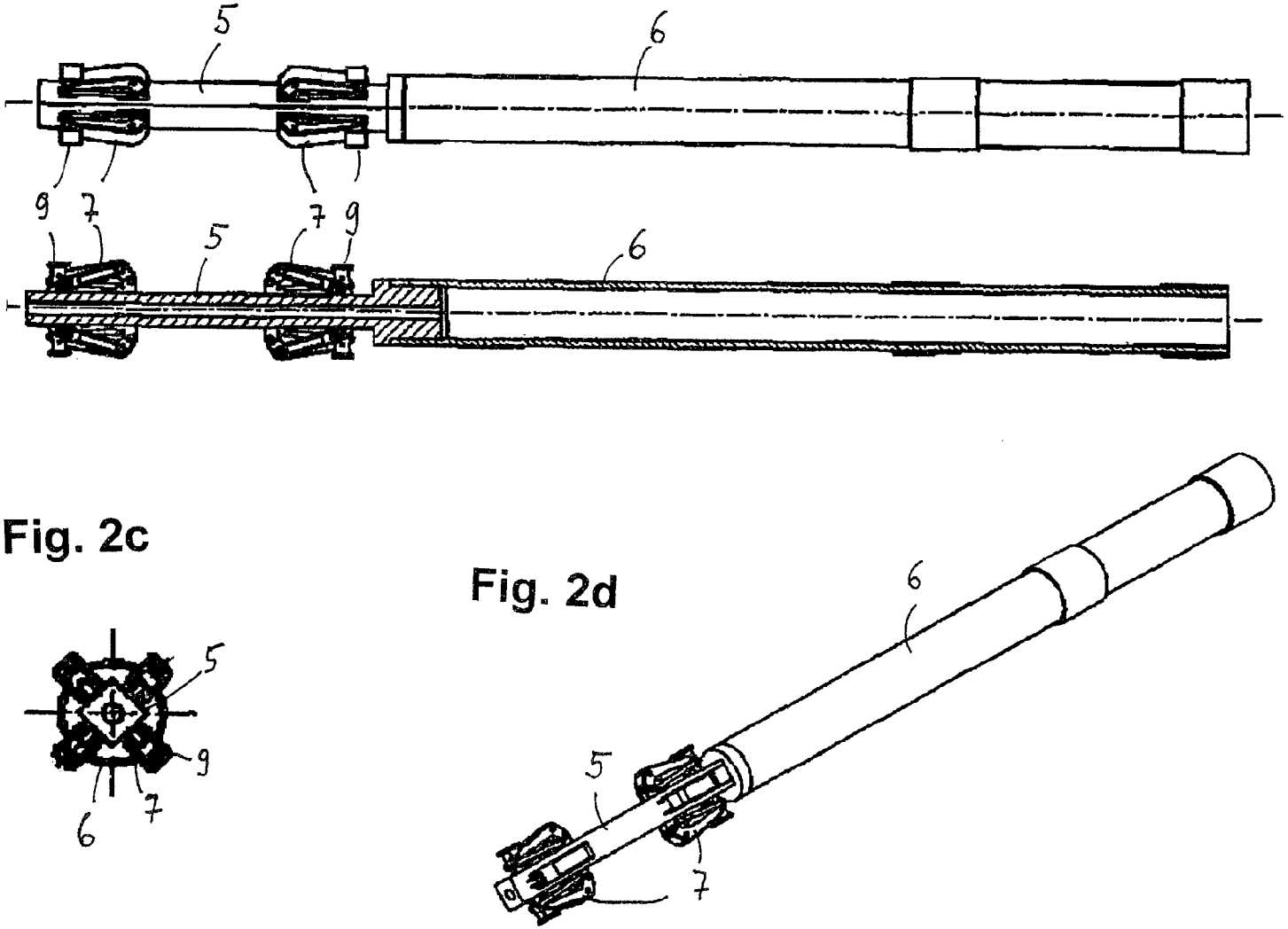
FIGS. 2*a* to *d* show a receiving sleeve with the holding levers refracted.
Figure 3A:
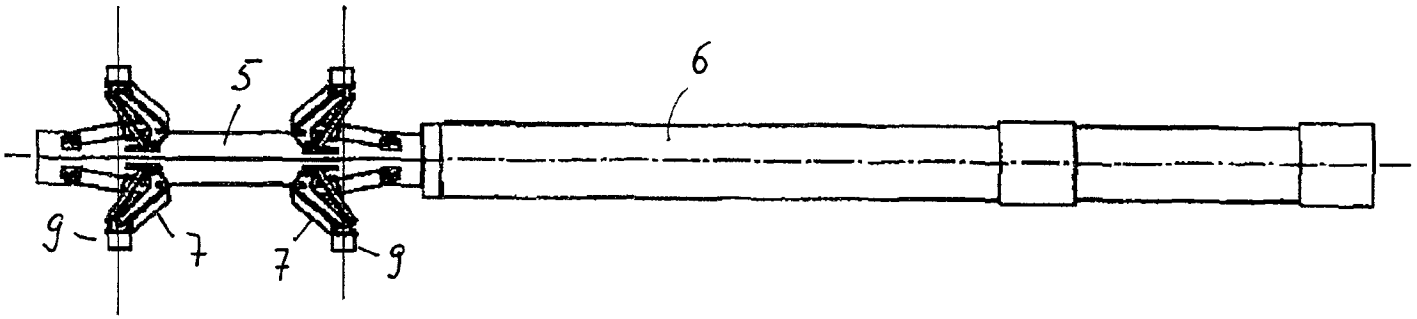
FIGS. 3*a* to *d* show the same with the holding levers extended.
Figure 3B:
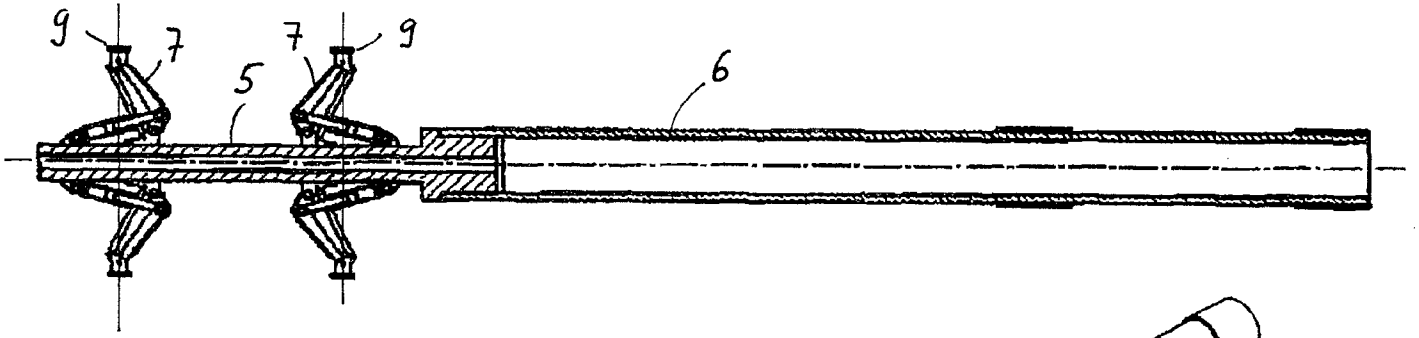
Figure 3C:
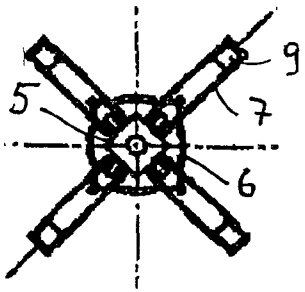
Figure 3D:
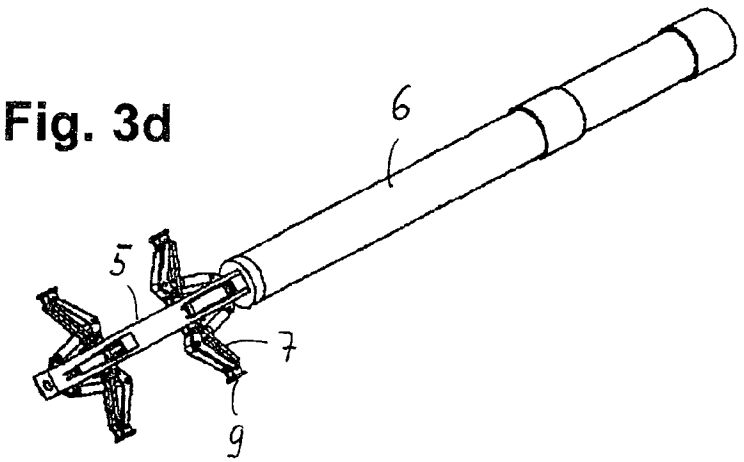

FIG. 2*a* shows a side view of the pipe manipulator consisting of receiving sleeve 5, feed rod 6, the four holding levers 7 in the retracted state and the force introducing surfaces 9 thereof. FIG. 2*b* shows a 45 degree section, FIG. 2*c* shows a frontal view in the axial direction, and FIG. 2*d* shows an isometric illustration. In the same manner, FIG. 3*a* shows a side view of the pipe manipulator consisting of receiving sleeve 5, feed rod 6, the four holding levers 7 in the extended state and the force introducing surfaces 9 thereof. The holding planes 10 are also shown here. FIG. 3*b* shows a 45 degree section, FIG. 3*c* shows a frontal view in the axial direction, and FIG. 3*d* shows an isometric illustration.

While the invention has been described with reference to particular embodiments thereof, it will be understood by those having ordinary skill the art that various changes may be made therein without departing from the scope and spirit of the invention. Further, the present invention is not limited to the embodiments described herein; reference should be had to the appended claims.

LIST OF REFERENCE NUMBERS

1 Bending lock
2 Bending axis of rotation
3 Induction ring
4 Feed carriage
5 Receiving sleeve
6 Feed rod
7 Holding lever
8 Pipe
9 Force introducing surface
10 Holding plane

The invention claimed is:

1. A pipe manipulator for moving a pipe in an apparatus for bending a pipe having a large diameter, wherein the apparatus includes a feeding device, a heating device configured to annularly surround the pipe, at least one bending arm disposed axially downstream from the heating device in a pipe feed direction, and a bending lock disposed on the at least one bending arm and configured to grasp a pipe section to be bent and to move around a bending axis of rotation during a feeding of the pipe, the pipe manipulator comprising:

a receiving sleeve axially displaceable in the pipe feed direction and disposed displaceably in the feeding device at an end of the pipe, wherein the receiving sleeve is configured to reach into the pipe and to firmly clamp the pipe from an inside of the pipe and to guide the pipe in a defined manner axially through the heating device into the bending lock, wherein the receiving sleeve is configured to fix the pipe in at least two holding planes perpendicular to a center axis of the pipe, the at least two holding planes being longitudinally offset with respect to each other along the center axis of the pipe, wherein the receiving sleeve includes a holding apparatus disposed in each of the at least two holding planes and configured to press the pipe from the inside of the pipe so as to frictionally fix the pipe in the at least two holding planes, and wherein the receiving sleeve is rotatable about its longitudinal axis within the pipe.

2. The pipe manipulator as recited in claim 1, wherein the holding apparatuses each include a holding lever actuatable by a hydraulic system in the receiving sleeve so as to expand concentrically, each holding lever having a force introducing element disposed at an outer end of the holding lever for the inside of the pipe.

3. The pipe manipulator as recited in claim 2, wherein each holding apparatus includes a plurality of holding levers distributed uniformly over a circumference of the receiving sleeve.

* * * * *